US011300910B2

(12) United States Patent
Shimada

(10) Patent No.: US 11,300,910 B2
(45) Date of Patent: Apr. 12, 2022

(54) FIXING DEVICE AND IMAGE FORMING APPARATUS

(71) Applicant: Oki Electric Industry Co., Ltd., Tokyo (JP)

(72) Inventor: Takenori Shimada, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/373,338

(22) Filed: Jul. 12, 2021

(65) Prior Publication Data

US 2022/0075301 A1 Mar. 10, 2022

(30) Foreign Application Priority Data

Sep. 10, 2020 (JP) ..... JP2020-152264

(51) Int. Cl.
*G03G 15/20* (2006.01)

(52) U.S. Cl.
CPC ..... *G03G 15/2057* (2013.01); *G03G 15/2064* (2013.01); *G03G 2215/2038* (2013.01)

(58) Field of Classification Search
CPC ..... G03G 15/2053; G03G 15/2057; G03G 15/206; G03G 15/2064; G03G 2215/2025; G03G 2215/2035; G03G 2215/2038
See application file for complete search history.

(56) References Cited

U.S. PATENT DOCUMENTS

| | | | | |
|---|---|---|---|---|
| 2014/0205334 | A1 | 7/2014 | Kondoh et al. | |
| 2019/0056686 | A1 | 2/2019 | Yagi | |
| 2020/0004183 | A1* | 1/2020 | Yabuki | G03G 15/2053 |
| 2020/0192253 | A1* | 6/2020 | Morihara | G03G 15/205 |

FOREIGN PATENT DOCUMENTS

| | | | |
|---|---|---|---|
| JP | 2008299314 | A | 12/2008 |
| JP | 2019128507 | A | 8/2019 |
| JP | 2020008754 | A | 1/2020 |

* cited by examiner

*Primary Examiner* — Hoang X Ngo
(74) *Attorney, Agent, or Firm* — Rabin & Berdo, P.C.

(57) ABSTRACT

Provided is a fixing device including an annular belt; a heating member provided on an inner peripheral surface's side of the annular belt; a facing member provided on a facing surface of the heating member facing the inner peripheral surface; and a pressing member that is provided on an outer peripheral surface's side of the annular belt and forms a nip region between the pressing member and the facing member via the annular belt, wherein the facing member includes resin and carbon.

20 Claims, 10 Drawing Sheets

FIG. 9
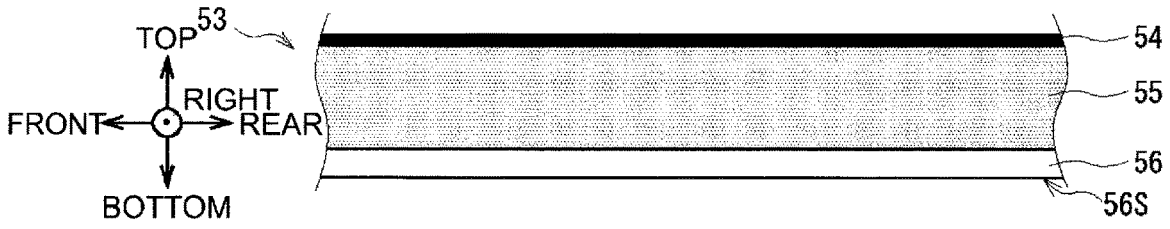
FIG. 10
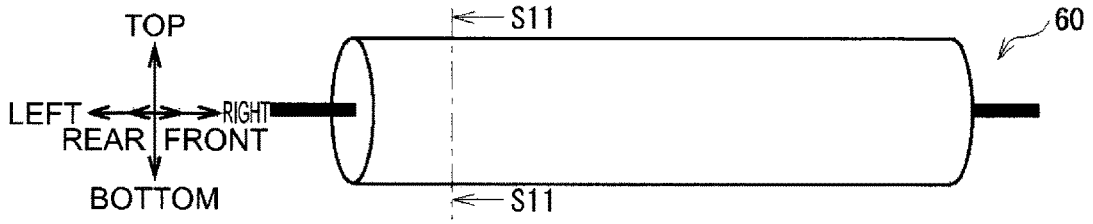
FIG. 11
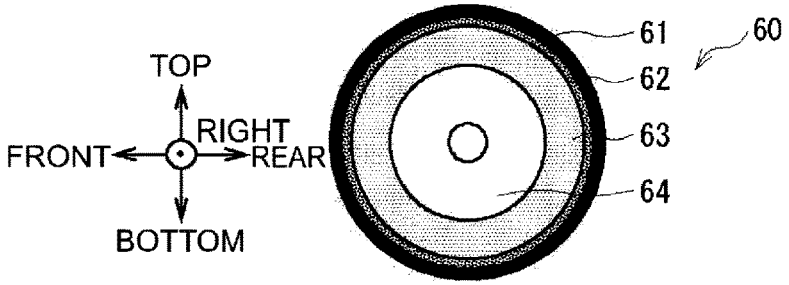
FIG. 12
TB1
| MEASUREMENT STEP | START TEMPERATURE [°C] | END TEMPERATURE [°C] | TEMPERATURE RISE/ DROP SPEED [°C/min] | HOLDING TIME [min] | MEASUREMENT ATMOSPHERE |
|---|---|---|---|---|---|
| 1 | 25 | 600 | 20 | 10 | NITROGEN |
| 2 | 600 | 400 | 20 | 5 | NITROGEN |
| 3 | 400 | 800 | 10 | 5 | AIR |

FIG. 13

TB2

| SAMPLE | Sa | Sb | Sc | Sd | Se | Sf |
|---|---|---|---|---|---|---|
| GRAPHITE WEIGHT COMPOUND RATIO [wt%] | 0 | 11 | 13 | 22 | 34 | 49 |
| GRAPHITE VOLUME COMPOUND RATIO [vol%] | 0 | 8 | 9 | 15 | 25 | 38 |
| THERMAL DIFFUSIVITY [$mm^2/s$] | 27.5 | 38.0 | 38.9 | 42.9 | 45.4 | 48.3 |
| SURFACE ROUGHNESS Ra [μm] | 0.65 | 0.95 | 1.22 | 1.34 | 1.56 | 1.95 |
| FIXATION LIMIT TEMPERATURE [°C] | Ref | −0.81 | −0.88 | −1.19 | −1.38 | −1.60 |
| PRESENCE/ABSENCE OF OCCURRENCE OF VERTICAL STREAK | ○ | ○ | ○ | ○ | ○ | × |
| FIXABILITY IMPROVEMENT | × | ○ | ○ | ○ | ○ | ○ |

FIG. 14

TB3

| | FRICTIONAL WEAR TEST | LONGITUDINAL FEED PRINTING OF 60k A4 SHEETS |
|---|---|---|
| PRESSURE [Pa] | $2.12\times10^8$ | $1.74\times10^4$ |
| SLIDE DISTANCE [m] | 10 | $1.20\times10^5$ |
| INTEGRATED PRESSURE [Pa·m] | $2.1\times10^9$ | $2.1\times10^9$ |

FIG. 15

TB4

| SAMPLE | Sa | Sb | Sc | Sd | Se | Sf |
|---|---|---|---|---|---|---|
| GRAPHITE WEIGHT COMPOUND RATIO [wt%] | 0 | 11 | 13 | 22 | 34 | 49 |
| GRAPHITE VOLUME COMPOUND RATIO [vol%] | 0 | 8 | 9 | 15 | 25 | 38 |
| WEAR DEPTH [μm] | 0.0 | 2.0 | 2.4 | 4.5 | 6.9 | 9.6 |

FIXING DEVICE AND IMAGE FORMING APPARATUS

BACKGROUND OF THE INVENTION

1. Field of the Invention

The disclosure relates to a fixing device and an image forming apparatus, and is suitable for application to printers of the electrophotographic type, for example.

2. Description of the Related Art

Conventionally, there has been widespread an image forming apparatus (referred to also as a printer) that performs a printing process by making an image forming section form a developing agent image by using toners (referred to also as developing agents) based on an image supplied from computer equipment or the like, transferring the developing agent image onto a medium such as paper, and making a fixing device fix the image on the medium by applying heat and pressure to the image.

As an example of the fixing device, there is a fixing device in which a heating member is arranged to face an inner peripheral surface of an annular belt and a fixation nip part transmits heat to the fixation belt via a facing member (see Patent Reference 1, for example). Patent Reference 1 is Japanese Patent Application Publication No. 2019-128507.

While it is desirable to efficiently transmit the heat generated by the heating member provided on the inner peripheral surface of the annular belt to the annular belt, the heat generated by the heating member is not transmitted efficiently to the annular belt.

SUMMARY OF THE INVENTION

An object of the disclosure is to provide a fixing device and an image forming apparatus capable of increasing the efficiency of the transmission of the heat from the heating member to the annular belt.

A fixing device according to an aspect of the disclosure includes an annular belt; a heating member provided on an inner peripheral surface's side of the annular belt; a facing member provided on a facing surface of the heating member facing the inner peripheral surface; and a pressing member that is provided on an outer peripheral surface's side of the annular belt and forms a nip region between the pressing member and the facing member via the annular belt, wherein the facing member includes resin and carbon.

Further, a fixing device according to another aspect of the disclosure includes an annular belt; a heating member provided on an inner peripheral surface's side of the annular belt; and a facing member provided on a facing surface of the heating member facing the inner peripheral surface, wherein the facing member includes resin and a thermally conductive material having higher thermal conductivity than the resin, and a weight compound ratio of the thermally conductive material as a compound ratio of the thermally conductive material added relative to a weight ratio of the facing member is higher than or equal to 11 [wt %].

Furthermore, a fixing device according to yet another aspect of the disclosure includes an annular belt; a heating member provided on an inner peripheral surface's side of the annular belt; and a facing member provided on a facing surface of the heating member facing the inner peripheral surface, wherein the facing member includes resin and a thermally conductive material having higher thermal conductivity than the resin, and a volume compound ratio of the thermally conductive material as a compound ratio of the thermally conductive material added relative to a volume ratio of the facing member is higher than or equal to 8 [vol %].

An image forming apparatus according to an aspect of the disclosure includes the above-described fixing device.

According to the disclosure, it is possible to realize a fixing device and an image forming apparatus capable of increasing the efficiency of the transmission of the heat from the heating member to the annular belt.

BRIEF DESCRIPTION OF THE DRAWINGS

In the attached drawings,

FIG. 9 is a cross-sectional view showing the configuration of a fixation belt;

FIG. 10 is a perspective view showing a configuration (1) of a pressure roller;

FIG. 11 is a cross-sectional view showing a configuration (2) of the pressure roller and taken along the line S11-S11 in FIG. 10 in the direction of the arrows;

FIG. 12 is a table showing a thermogravimetry-differential thermal analysis;

FIG. 13 is a table showing result of a judgment;

FIG. 14 is a table showing pressure and slide distance;

FIG. 15 is a table showing the relationship among a graphite weight compound ratio, a graphite volume compound ratio and a slide member wear depth;

DETAILED DESCRIPTION OF THE INVENTION

A fixing device and an image forming apparatus according to each embodiment will be described below with reference to drawings. The following embodiments are just examples and it is possible to appropriately modify the embodiments.

1. Configuration of Image Forming Apparatus

Figure 1:
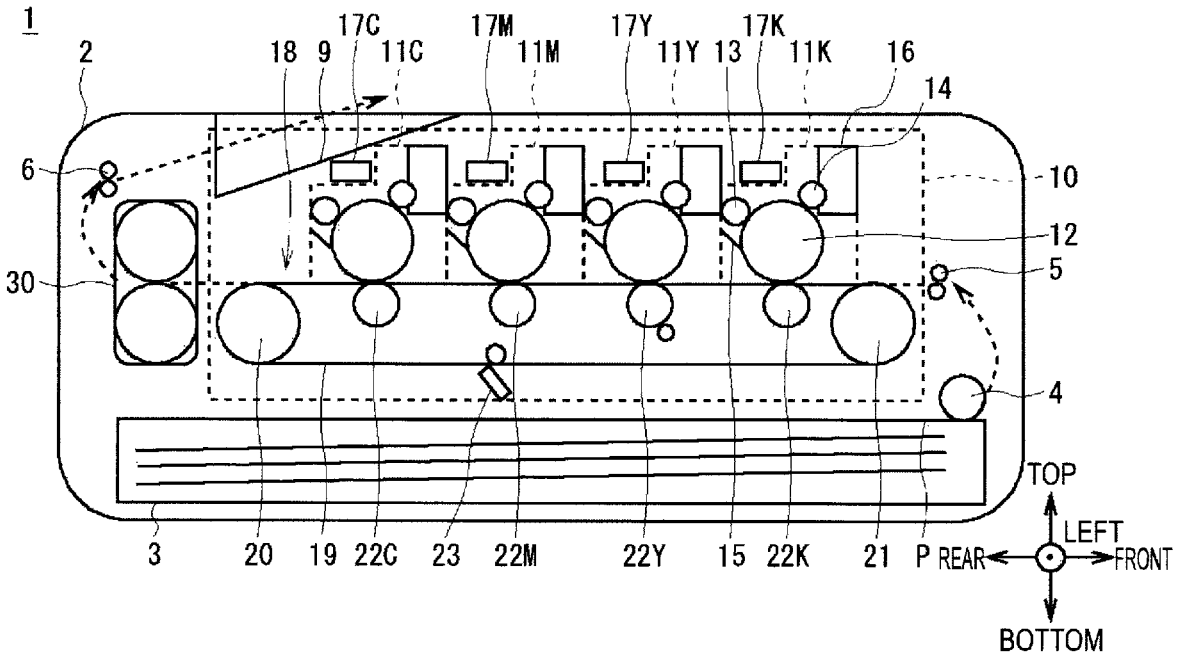
FIG. 1 is a left side view showing the configuration of an image forming apparatus.

As shown in FIG. 1, an image forming apparatus 1 is a printer using the electrophotographic method, for example, and forms a black and white image or a color image on a record medium P such as paper by performing an image forming operation by using one or more developing agents such as toners. In the following description, a position close to a sheet feed tray 3 or a direction heading towards the sheet feed tray 3 as viewed from an arbitrary position in a conveyance path through which the record medium P is conveyed will be referred to as an upper stream or being upstream. Further, a position close to a stacker 9 onto which the record medium P is ejected and loaded or a direction heading towards the stacker 9 as viewed from an arbitrary position in the conveyance path will be referred to as a lower stream or being downstream. Furthermore, a direction heading from the upper stream towards the lower stream will be referred to as a conveyance direction.

In a box-shaped printer housing 2, the image forming apparatus 1 includes the sheet feed tray 3, a hopping roller 4, a registration roller pair 5, an image forming section 10, a fixing device 30 and an ejection roller pair 6.

The sheet feed tray 3 is arranged in a lower part of the printer housing 2 and stores a plurality of record media P in a stacked state. The hopping roller 4 is provided downstream of the sheet feed tray 3.

The hopping roller 4 presses against the surface of the record medium P and sends out the record medium P downstream along the conveyance path. The hopping roller 4 is rotated around a central axis of the hopping roller 4 as a rotation axis by motive power transmitted from a hopping motor (not shown). The registration roller pair 5 is provided downstream of the hopping roller 4.

The registration roller pair 5 conveys the record medium P towards the image forming section 10. While conveying the record medium P, the registration roller pair 5 corrects the skewing of the record medium P by catching a front end part of the record medium P butting against the registration roller pair 5. The image forming section 10 is provided downstream of the registration roller pair 5. The image forming section 10 transfers an image onto the record medium P and conveys the record medium P to the fixing device 30.

The fixing device 30 fixes the image, transferred onto the record medium P conveyed from a transfer belt unit 18 of the image forming section 10, on the record medium P by applying heat and pressure to the image, and conveys the record medium P towards the ejection roller pair 6 along the conveyance path. The ejection roller pair 6 is provided downstream of the fixing device 30.

The ejection roller pair 6 conveys the record medium P towards the stacker 9. By this operation, the image forming apparatus 1 ejects the record medium P to the stacker 9 provided outside the printer housing 2 and loaded with record media P having images fixed thereon

2. Configuration of Image Forming Section

The image forming section 10 is a mechanism that forms an image (toner image) and transfers the image onto the record medium P. The image forming section 10 includes four development units 11 (development units 11K, 11Y, 11M and 11C), four exposure units 17 (exposure units 17K, 17Y, 17M and 17C) and the transfer belt unit 18. The development units 11K, 11Y, 11M and 11C are arranged in this order along the conveyance direction of the record medium P. In the following description, the development units 11K, 11Y, 11M and 11C will also be referred to collectively as a development unit 11, and the exposure units 17K, 17Y, 17M and 17C will also be referred to collectively as an exposure unit 17.

The development unit 11 forms images by using toners as developing agents based on print data transmitted from a host device such as a personal computer. The development units 11K, 11Y, 11M and 11C respectively form black, yellow, magenta and cyan images. The development units 11K, 11Y, 11M and 11C have the same configuration except in that the development units 11K, 11Y, 11M respectively form images by using toners of colors different from each other. Each development unit 11 includes a photosensitive drum 12, a charging roller 13, a development roller 14, a cleaning blade 15 and a toner storage section 16.

The photosensitive drum 12, as a cylindrical member for carrying an electrostatic latent image on its surface (surface part), is formed by using a photo conductor (e.g., organic photo conductor). This photosensitive drum 12 is rotated clockwise in FIG. 1 by motive power transmitted from a photo conductor motor (not shown). The photosensitive drum 12 is electrically charged by the charging roller 13 and is exposed to light by a corresponding exposure unit 17. By this operation, an electrostatic latent image is formed on the surface of the photosensitive drum 12. Then, the toner is supplied from the development roller 14, by which an image corresponding to the electrostatic latent image is formed (developed) on the photosensitive drum 12.

The charging roller 13 is configured to electrically charge the surface (surface part) of the photosensitive drum 12. The charging roller 13 is arranged to make contact with the surface (circumferential surface) of the photosensitive drum 12 and to be pressed against the photosensitive drum 12 at a prescribed pressing level. The charging roller 13 rotates counterclockwise in FIG. 1 according to the rotation of the photosensitive drum 12. A prescribed charging voltage is applied to the charging roller 13.

The development roller 14 is configured to carry the electrically charged toner on its surface. This development roller 14 is arranged to make contact with the surface (circumferential side face) of the photosensitive drum 12 and to be pressed against the photosensitive drum 12 at a prescribed pressing level. The development roller 14 is rotated counterclockwise in FIG. 1 by motive power transmitted from the photo conductor motor (not shown). A prescribed development voltage is applied to the development roller 14.

The cleaning blade 15 is a member that cleans the surface of the photosensitive drum 12 by scraping off the toner remaining on the surface of the photosensitive drum 12. This cleaning blade 15 is arranged to make contact with the surface of the photosensitive drum 12 in a counter direction and to be pressed against the photosensitive drum 12 at a prescribed pressing level.

The toner storage section 16 is configured to store the toner. Specifically, the toner storage sections 16 of the development units 11K, 11Y, 11M and 11C respectively store black, yellow, magenta and cyan toners.

Each exposure unit 17 (exposure unit 17K, 17Y, 17M, 17C), as a mechanism that applies light to the photosensitive drum 12 of the development unit 11, is formed by using an LED (Light Emitting Diode) head, for example. By the exposure unit 17, the electrostatic latent image is formed on the surface of the photosensitive drum 12. Then, an image corresponding to the electrostatic latent image is formed on the photosensitive drum 12.

The transfer belt unit 18 is a mechanism that transfers the image formed on the surface of each photosensitive drum 12 onto the surface of the record medium P by means of Coulomb force and conveys the record medium P in the conveyance direction. The transfer belt unit 18 conveys the record medium P having the transferred image thereon towards the fixing device 30. The transfer belt unit 18 includes a transfer belt 19, a drive roller 20, a driven roller 21, four transfer rollers 22 (transfer rollers 22K, 22Y, 22M and 22C) and a cleaning blade 23.

The transfer belt 19 is an annular belt formed seamlessly and capable of holding and carrying the record medium P. The transfer belt 19 is stretched between the drive roller 20 and the driven roller 21. The drive roller 20, as a rotary member rotated by motive power transmitted from a belt motor (not shown) so as to convey the record medium P towards the fixing device 30, rotates the transfer belt 19 in a circulating manner. The driven roller 21 is a member that stretches the transfer belt 19 in cooperation with the drive roller 20 while adjusting tension applied to the transfer belt 19. The four transfer rollers 22 are rotary members that respectively transfer the image formed on the surface of the photosensitive drum 12 of the corresponding development unit 11 onto a transfer target surface of the record medium P. The transfer rollers 22K, 22Y, 22M and 22C are respectively arranged to face the photosensitive drums 12 of the development units 11K, 11Y, 11M and 11C via the transfer belt 19. A prescribed transfer voltage is applied to each of the transfer rollers 22K, 22Y, 22M and 22C, by which the image formed on the photosensitive drum 12 by the development unit 11 is transferred onto the transfer target surface of the record medium P. The cleaning blade 23 is a member that cleans the surface of the transfer belt 19 by scraping off waste toners remaining on the surface of the transfer belt 19. The fixing device 30 is provided downstream of the image forming section 10.

3. Configuration of Fixing Device

Figure 2:
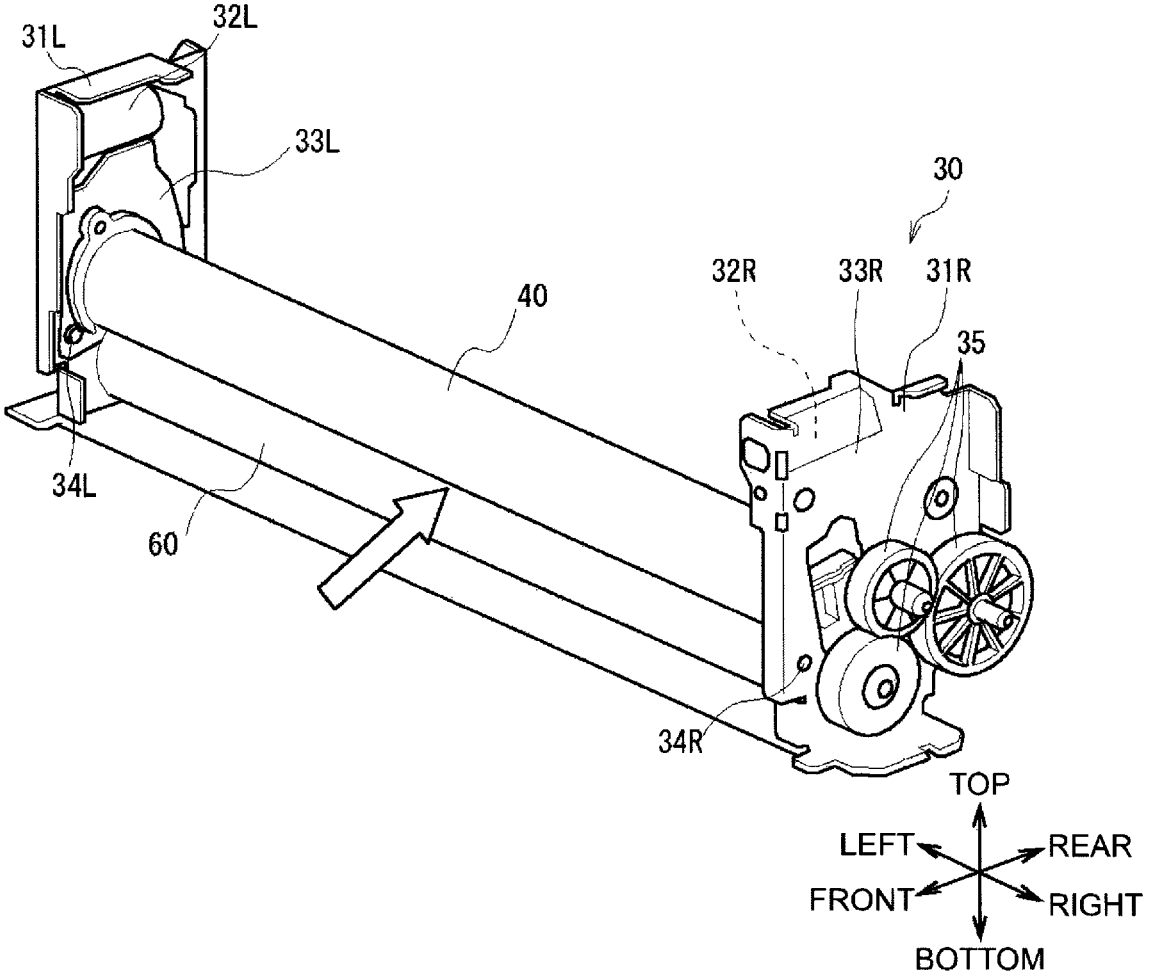
FIG. 2 is a perspective view showing a configuration (1) of a fixing device.
Figure 3:
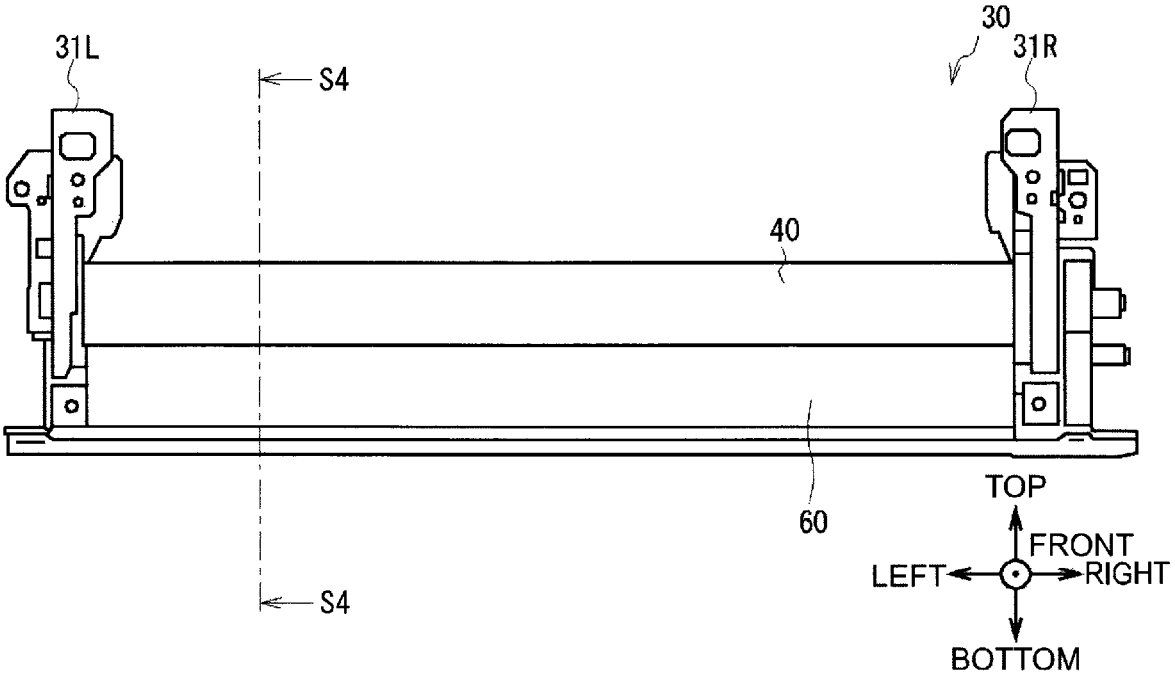
FIG. 3 is a front view showing a configuration (2) of the fixing device.

The detailed configuration of the fixing device 30 will be described below with reference to FIG. 2, FIG. 3, FIG. 4, FIG. 5, FIG. 6, FIG. 7, FIG. 8, FIG. 9, FIG. 10 and FIG. 11. As shown in FIG. 2, the fixing device 30 includes side frames 31L and 31R, springs 32L and 32R, levers 33L and 33R, a drive gear 35, a fixation belt unit 40 and a pressure roller 60.

Figure 4:
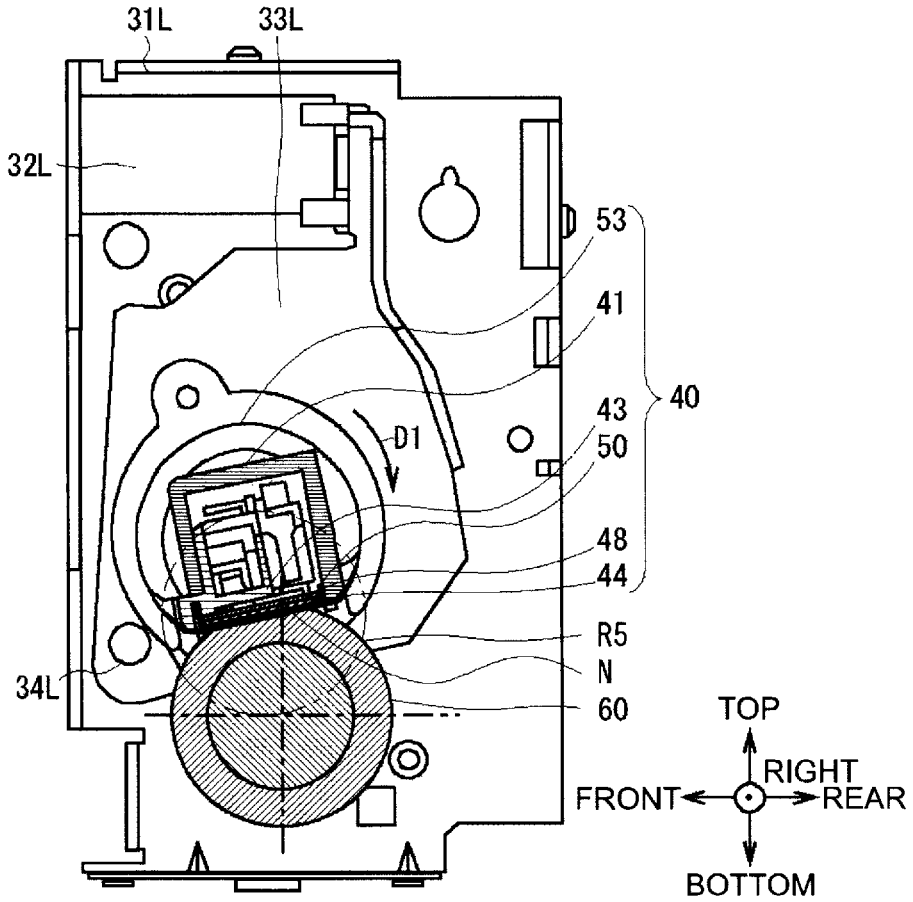
FIG. 4 is a cross-sectional view showing a configuration (3) of the fixing device and taken along the line S4-S4 in FIG. 3 in the direction of the arrows.

The side frames 31L and 31R are, for example, members fixed to the printer housing 2 of the image forming apparatus 1 by using screws or the like. As shown in FIG. 2 and FIG. 4, the spring 32L is an elastic member such as a spring, for example, and applies biasing force to the lever 33L. One end of the spring 32L is fixed to the side frame 31L and the other end of the spring 32L is fixed to the lever 33L. Similarly to the spring 32L, the spring 32R is an elastic member such as a spring and applies biasing force to the lever 33R. Due to the biasing force applied from the spring 32L, the lever 33L rotates in a direction D1 around a rotary bearing 34L extending in a transverse direction as a rotary shaft. The lever 33L is attached to the side frame 31L. Similarly to the lever 33L, due to the biasing force applied from the spring 32R, the lever 33R rotates in the direction D1 around a rotary bearing 34R extending in the transverse direction as a rotary shaft. When the fixing device 30 does not perform the fixing operation, the levers 33L and 33R are pressed and retained at prescribed positions by lever retaining members (not shown). Specifically, since the spring 32L is compressed by the lever retaining member via the lever 33L, the spring 32L can apply the biasing force to the lever 33L when the lever 33L is released from the lever retaining member. The same goes for the spring 32R. The drive gear 35 transmits motive power supplied from an annular belt motor (not shown) to the pressure roller 60.

With this configuration, when the fixing device 30 performs the fixing operation, the drive gear 35 transmits the motive power supplied from the annular belt motor to the pressure roller 60. Further, due to the release of the levers 33L and 33R from the lever retaining members in response to the operation of the drive gear 35, the levers 33L and 33R rotate in the direction D1 around the rotary bearings 34L and 34R as the rotary shafts. Accordingly, the fixation belt unit 40 attached to the levers 33L and 33R is pressed against the pressure roller 60, by which a nip part N is formed in the fixation belt unit 40 and the pressure roller 60. FIG. 4 shows the state in which the nip part N has been formed in the fixation belt unit 40 and the pressure roller 60. By the passage of the record medium P through the nip part N, heat and pressure are applied to the image transferred onto the record medium P and the image is fixed on the record medium P.

4. Configuration of Fixation Belt Unit

Figure 5:
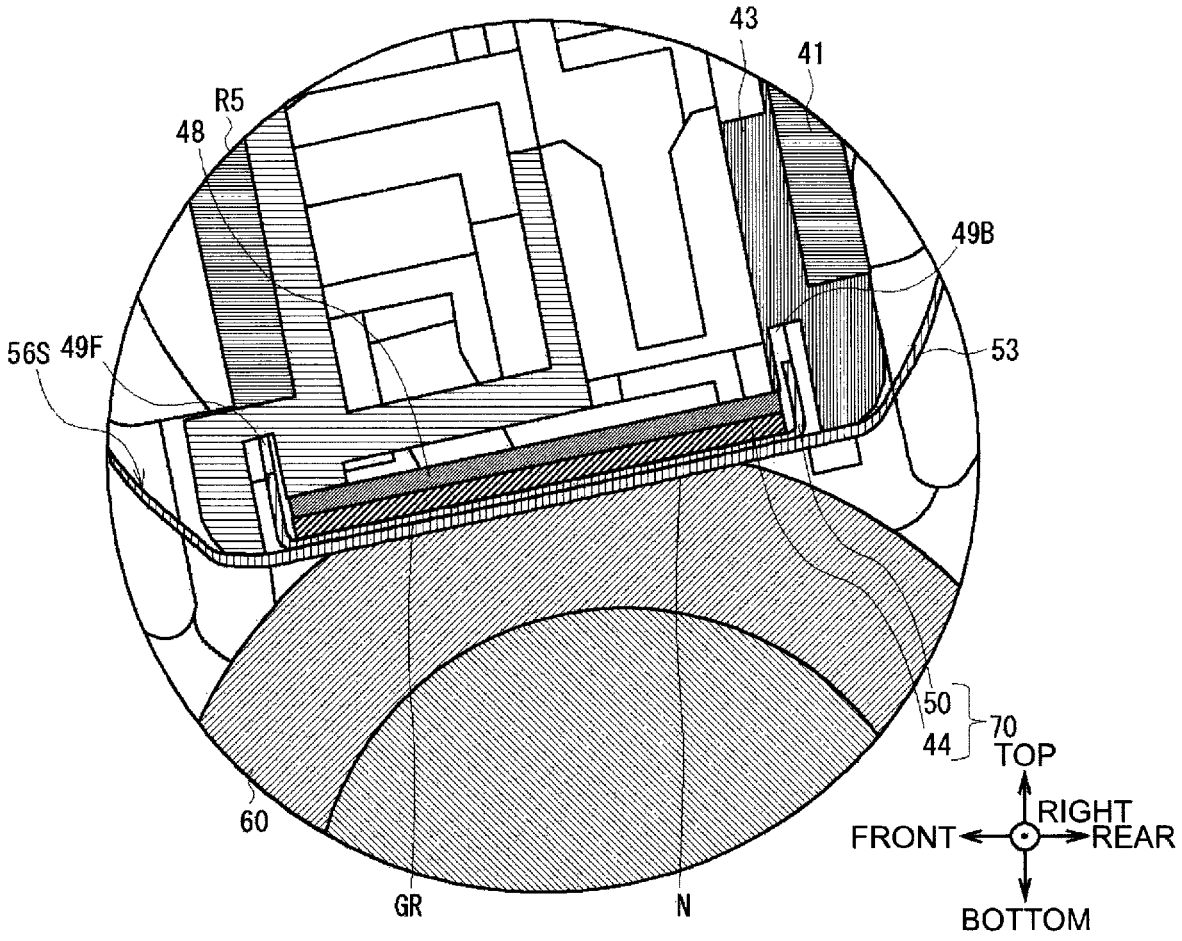
FIG. 5 is an enlarged sectional view showing a configuration (4) of the fixing device and excerpting the region R5 in FIG. 4.
Figure 6:
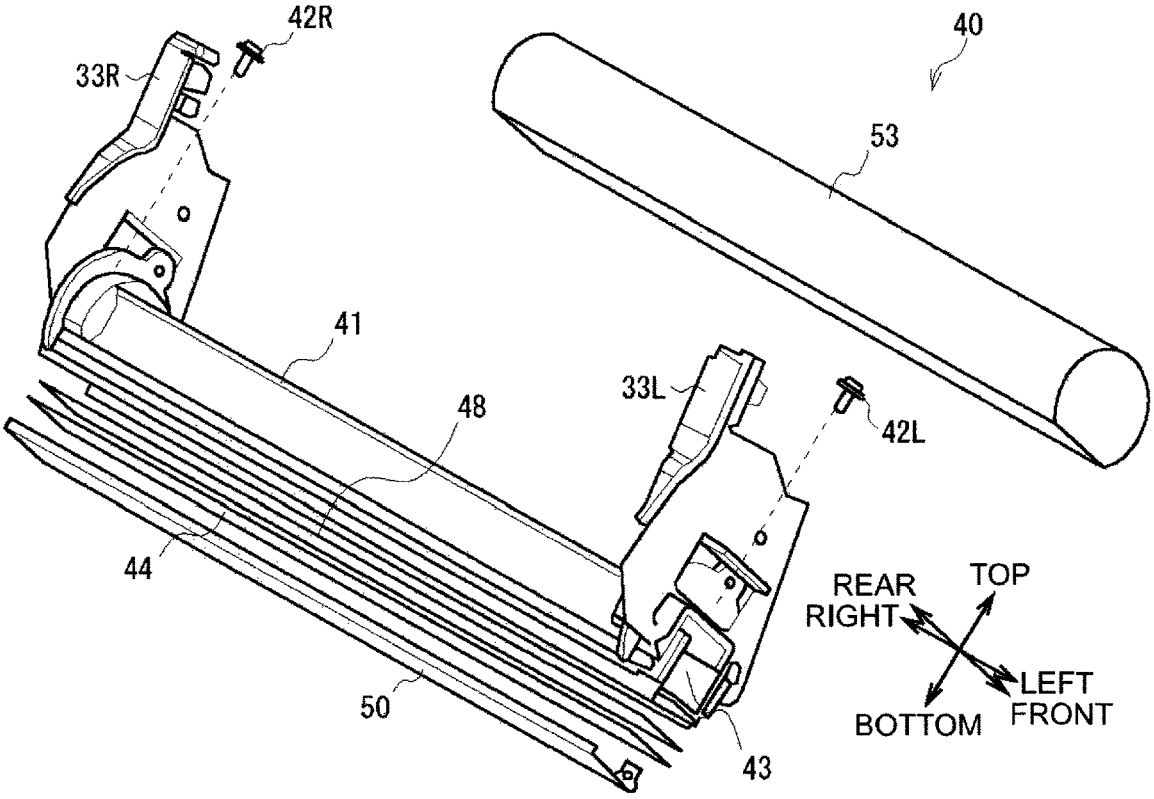
FIG. 6 is an exploded perspective view showing the configuration of a fixation belt unit.

The fixation belt unit 40 is configured to apply heat to the image on the record medium P. As shown in FIG. 4 to FIG. 6, the fixation belt unit 40 includes a stay 41, a holding member 43, a heater 44, a heat storage plate 48, a heat diffusion member 50 and a fixation belt 53. The stay 41 is a member that supports the fixation belt 53. The stay 41 is fixed to the lever 33L by using a screw 42L and fixed to the lever 33R by using a screw 42R. The holding member 43 is a member that holds the heater 44, the heat storage plate 48 and the heat diffusion member 50. The holding member 43 is fixed to the stay 41. As shown in FIG. 5 and FIG. 6, the heat storage plate 48, the heater 44, the heat diffusion member 50 and the fixation belt 53 are arranged in this order from top to bottom. Namely, the heat storage plate 48 faces the heater 44, the heater 44 faces the heat diffusion member 50, and the heat diffusion member 50 faces the fixation belt 53. In the following description, the heat diffusion member 50 and the heater 44 will also be referred to collectively as a heating member 70.

The heater 44, as a plate-shaped member extending in the transverse direction, is a heat source for heating the fixation belt 53 and includes a plurality of (e.g., five) heating parts aligned in a width direction (transverse direction) orthogonal to a rotation direction of the fixation belt 53. For example, when an image is formed on a record medium P that is wide in the transverse direction such as a A3 sheet, the fixation belt unit 40 makes all the heating parts of the heater 44 generate heat. In contrast, when an image is formed on a record medium P that is narrow in the transverse direction such as a postcard, for example, the fixation belt unit 40 makes only heating parts in a central part in the transverse direction generate heat and thereby holds down the energy consumption. As above, the fixation belt unit 40 selectively energizes the heating parts depending on the width of the record medium P in the transverse direction and makes the energized heating parts generate heat.

The heat storage plate 48 is a member that stores the heat generated by the heater 44. In this example, the heat storage plate 48 is a plate-shaped member extending in the transverse direction along the heater 44. The heat storage plate 48 inhibits the heat generated by the heater 44 from being transmitted to a side of the heat storage plate 48 opposite to a side facing the heater 44. Incidentally, while the fixation belt unit 40 is configured to include the heat storage plate 48 in this example, the configuration of the fixation belt unit 40 is not limited to this example; the fixation belt unit 40 may also be configured to include no heat storage plate 48.

Between the heater 44 and the heat storage plate 48, thermally conductive grease is applied in order to efficiently transmit the heat generated by the heater 44. Similarly, the thermally conductive grease is applied between the heater 44 and the heat diffusion member 50. The heater 44 and the heat storage plate 48 are arranged to be sandwiched between the holding member 43 and the heat diffusion member 50, and are fixed by the holding member 43. Incidentally, while the thermally conductive grease is applied between the heater 44 and the heat storage plate 48 in this example, the configuration is not limited to this example; it is permissible even if no thermally conductive grease is applied between the heater 44 and the heat storage plate 48. Further, while the thermally conductive grease is applied between the heater 44 and the heat diffusion member 50 in this example, the configuration is not limited to this example; it is permissible even if no thermally conductive grease is applied between the heater 44 and the heat diffusion member 50.

(5. Configuration of Heat Diffusion Member)

Figure 7:
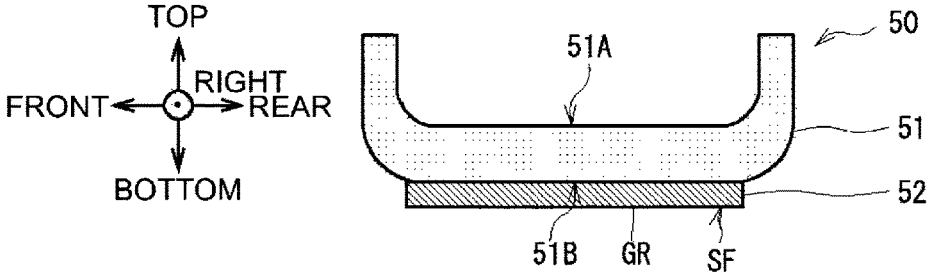
FIG. 7 is a cross-sectional view showing the configuration of a heat diffusion member.

The heat diffusion member 50 is a metal plate member in a substantially flat plate shape extending in the transverse direction along the heater 44 and is configured to transmit the heat generated by the heater 44 to the fixation belt 53. The heat diffusion member 50 is in a shape like the upper case character "U" in a right side view and its front and rear end parts are bent upward in a vertical direction as a thickness direction. Namely, the heat diffusion member 50 has a concave part facing the heater 44. As shown in FIG. 5, convex parts of the heat diffusion member 50 formed by bending the front and rear end parts upward are inserted into holding grooves 49F and 49B formed in the holding member 43. Since the holding grooves 49F and 49B are spaces wider than the convex parts of the heat diffusion member 50, the heat diffusion member 50 inserted into the holding grooves 49F and 49B can move in the thickness direction (substantially vertical direction) when the fixation belt unit 40 is pressed against the pressure roller 60. Specifically, when the fixing device 30 performs the fixing operation, the heat diffusion member 50 is pressed against the heater 44. At that time, the heat diffusion member 50 transmits the heat generated by the heater 44 to the fixation belt 53. As shown in FIG. 7, the heat diffusion member 50 includes a base member 51 and a slide member 52.

(5-1. Configuration of Base Member)

The base member 51 has a counter facing surface 51A facing the heater 44 and a facing surface 51B on a side opposite to the counter facing surface 51A. The slide member 52 is formed on the facing surface 51B of the base member 51. The counter facing surface 51A faces an inner peripheral surface 56S (FIG. 5) of the fixation belt 53. As mentioned earlier, the base member 51 is in a shape like the upper case character "U" in a right side view and its front and rear end parts are bent upward in the vertical direction as the thickness direction. The base member 51 uniformizes temperature difference at seams between heating parts in the heater 44.

The base member 51 is configured to include a metal whose thermal diffusivity indicating the speed of heat transmission is high, for example. In this example, the main component of the base member 51 is aluminum (Al). Here, the main component means a component that occupies at least 50 [wt %] of the whole of the base member 51. Namely, the content percentage of Al in the base member 51 is higher than those of other materials. Incidentally, while the base member 51 is configured to include Al in this example, the configuration of the base member 51 is not limited to this example; the base member 51 may also be configured to include a different metal whose thermal diffusivity is high. The base member 51, which is required to have sufficient thermal conductivity capable of uniformizing the temperature difference at the seams between heating parts in the heater 44, may also be configured to include stainless steel (SUS), copper or zinc (Zn), for example. Incidentally, the thickness of the base member 51 is not limited to the illustrated thickness.

(5-2. Configuration of Slide Member)

The slide member 52 is a contact member that has a slide surface SF facing the inner peripheral surface 56S (FIG. 5) of the fixation belt 53 and makes contact with the inner peripheral surface 56S of the fixation belt 53 via slide grease GR (described later). Here, "the slide surface SF of the slide member 52 faces the inner peripheral surface 56S of the fixation belt 53" means that the slide surface SF is in an arrangement relationship of facing each other with the inner peripheral surface 56S. In this case, to "face" also means that the slide surface SF is in an arrangement relationship of contacting and facing each other with the inner peripheral surface 56S or that the slide surface SF is in an arrangement relationship of facing each other with the inner peripheral surface 56S via another member such as the slide grease GR which will be described later. The heater 44 is situated on a side of the base member 51 opposite to the slide surface SF. The slide member 52 is configured to include resin having high slidability on the inner peripheral surface 56S of the fixation belt 53, for example. The thickness of the slide member 52 is greater than or equal to 2.1 [μm] and is desired to be less than or equal to 9.7 [μm]. Here, the thickness of the slide member 52 is the distance from the facing surface 51B of the base member 51 of the heat diffusion member 50 to the slide surface SF of the slide member 52 in a direction orthogonal to the facing surface 51B and heading towards the nip part N. Further, the thickness of the slide member 52 is not limited to the illustrated thickness.

(5-2-1. Configuration of Binder Resin)

Figure 8:
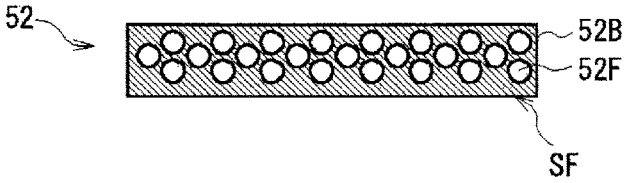
FIG. 8 is an enlarged view of FIG. 7 showing the configuration of a slide member.

As shown in FIG. 8, the slide member 52 includes binder resin 52B as the main component. The binder resin 52B forming the slide member 52 is, for example, polyamide-imide (PAI) having high tenacity. Here, the main component means a component that occupies at least 50 [wt %] of the whole of the slide member 52. Namely, the content percentage of PAI in the slide member 52 is higher than those of other materials.

(5-2-2. Configuration of Thermally Conductive Filler Particles)

Further, the slide member 52 includes a plurality of particulate fillers (hereinafter referred to as thermally conductive filler particles 52F) of graphite as carbon being a thermally conductive material. By including the thermally conductive filler particles 52F being graphite, the slide member 52 has increased further in the slidability and the thermal conductivity.

As shown in FIG. 8, the plurality of thermally conductive filler particles 52F are distributed discretely in the binder resin 52B, for example. Some of the plurality of thermally conductive filler particles 52F have a part exposed to the slide surface SF. Therefore, minute concave and convex structures are formed on the slide surface SF. Further, even when the slide surface SF has worn down due to the sliding on the inner peripheral surface 56S, the slide surface SF is capable of maintaining the minute concave and convex structures thanks to the plurality of thermally conductive filler particles 52F embedded in the binder resin 52B.

In this example, the slide member 52 is formed on the base member 51 by, for example, spraying a solvent of PAI on a surface of the base member 51 and hardening the resin by means of heating. The thickness of the slide member 52 is controlled by adjusting the number of times of the spraying, for example. In this example, the length of the slide member 52 in its lengthwise direction (transverse direction) is approximately 264.9 [mm], and the length of the slide member 52 in its short-side direction (depth direction) is approximately 17.55 [mm]. Thus, the slide member 52 covers substantially the whole of the facing surface 51B of the base member 51 facing the inner peripheral surface 56S of the fixation belt 53. The slide surface SF of the slide member 52 faces the fixation belt 53 as described earlier, and the inner peripheral surface 56S of the fixation belt 53 rotating in the circulating manner slides on the slide surface SF. A surface roughness of the slide surface SF of the slide member 52 in contact with the inner peripheral surface 56S of the fixation belt 53 is preferably higher than or equal to 0.95 [μm] and less than or equal to 1.56 [μm].

Therefore, in order to increase the slidability of the inner peripheral surface 56S on the slide surface SF, the slide grease GR is provided between the fixation belt 53 and the slide surface SF of the slide member 52 as shown in FIG. 5 and FIG. 7 by applying the slide grease GR as a lubricant on the slide surface SF, for example. Thus, the fixation belt 53 slides on the slide surface SF via the slide grease GR. The slide grease GR is, for example, gel-like grease and includes a silicone-based material or a fluorine-based material.

Incidentally, while the binder resin 52B of the slide member 52 includes PAI in this example, the binder resin 52B is not limited to this example and can include a different resin. As such a different resin, polyimide (PI) realizing excellent slidability of the fixation belt 53 and also excelling in heat resistance and mechanical strength can be taken as an example. Further, while the slide member 52 is configured to cover substantially the whole of the facing surface 51B of the base member 51 facing the inner peripheral surface 56S of the fixation belt 53, the configuration of the slide member 52 is not limited to this example; the slide member 52 may also be configured to cover part of the facing surface 51B of the base member 51, for example.

6. Configuration of Fixation Belt

The fixation belt 53 is an annular belt stretched by the stay 41 at prescribed tension, and is configured to be held to be rotatable. Further, the fixation belt 53 has the inner peripheral surface 56S facing the slide surface SF, and is provided so that the inner peripheral surface 56S slides on the slide surface SF. The fixation belt 53 forms the nip part N (FIG. 5) between the fixation belt 53 and the pressure roller 60. As shown in FIG. 9, the fixation belt 53 includes a surface layer 54, an elastic layer 55 and a base member layer 56. Namely, in the fixation belt 53, the elastic layer 55 is formed on the base member layer 56, and the surface layer 54 is formed on the elastic layer 55.

In this example, the surface layer 54 is configured to include a copolymer (PFA) of tetrafluoroethylene and perfluoro alkyl vinyl ether. The thickness of the surface layer 54 is 20 [μm], for example. The thickness of the surface layer 54 is desired to be a size that enables the surface layer 54 to follow the deformation of the elastic layer 55. In contrast, if the thickness of the surface layer 54 is too small, wrinkles occur to the surface layer 54 due to the sliding on the pressure roller 60 and the sliding on the record medium P, and thus the thickness of the surface layer 54 is desired to be 10 to 50 [μm]. Further, the surface layer 54 is desired to have heat resistance to withstand the fixation temperature and to have releasability to inhibit toners remaining on the fixation belt 53 and paper dust deriving from the record medium P from sticking to the surface layer 54, and thus is desired to be made of material obtained by fluorine substitution. Incidentally, the material of the surface layer 54 is not limited to the illustrated material, and the thickness of the surface layer 54 is not limited to the illustrated thickness.

In this example, the elastic layer 55 is configured to include silicone rubber having the heat resistance to withstand the fixation temperature. The rubber hardness of the elastic layer 55 is 12°, for example, and the thickness of the elastic layer 55 is 200 [μm], for example. The elastic layer 55 is desired to have rubber hardness and thickness with which the nip part N can be formed. On the other hand, the elastic layer 55 is desired to inhibit heat loss of the heat emitted from the heater 44 and to efficiently transmit the heat emitted from the heater 44 to an outer peripheral surface (toner contact surface) of the fixation belt 53. A great thickness of the elastic layer 55 facilitates the formation of a uniform nip part N, but is undesirable since heat capacity becomes high and heat loss becomes high. The thickness of the elastic layer 55 is desired to be 50 to 500 [μm]. The rubber hardness of the elastic layer 55 is desired to be 10° to 60° in order to increase the uniformity of the nip part N. Incidentally, while the elastic layer 55 is configured to include silicone rubber in this example, the configuration of the elastic layer 55 is not limited to this example; the elastic layer 55 may also be configured to include a different material having heat resistance to withstand the fixation temperature. For example, the elastic layer 55 may be configured to include fluororubber. Incidentally, the thickness of the elastic layer 55 is not limited to the illustrated thickness.

In this example, the base member layer 56 is configured to include polyimide (PI), and the main component of the base member layer 56 is PI. Here, the main component means a component that occupies at least 50 [wt %] of the whole of the base member layer 56. Namely, the content percentage of PI in the base member layer 56 is higher than those of other materials. The internal diameter of the base member layer 56 is 30 [mm], for example, and the thickness of the base member layer 56 is 80 [μm], for example. The base member layer 56 lets the fixation belt 53 exhibit high durability and high mechanical strength, and excels in mechanical strength, resistance to repetitive bending, and durability against buckling. In other words, since the base member layer 56 has a high Young's modulus and high buckling strength, the fixation belt 53 is unlikely to tear. Incidentally, while the base member layer 56 is configured to include PI in this example, the configuration of the base member layer 56 is not limited to this example; the base member layer 56 may also be configured to include a different material having high heat resistance, a high Young's modulus and high buckling strength, for example. For example, the base member layer 56 may be configured to include stainless steel or polyether ether ketone (PEEK)-based material. Especially, resin material excelling in heat resistance is desirable, such as polytetrafluoroethylene (PTFE), for example. The base member layer 56 may also be configured to include a material to which carbon black or electrically conductive filler including a metallic element such as zinc has been added, in which case the base member layer 56 is enabled to exhibit conductivity. The base member layer 56 may also be configured to include PTFE to which filler such as boron nitride has been added, in which case the slidability and the thermal conductivity of the base member layer 56 can be increased. Incidentally, the thickness of the base member layer 56 is not limited to the illustrated thickness.

7. Configuration of Pressure Roller

As shown in FIG. 10 and FIG. 11, the pressure roller 60 is a rotary member that is provided to be capable of making contact with the outer peripheral surface of the fixation belt 53 in the fixation belt unit 40 so that the nip part N is formed between the pressure roller 60 and the fixation belt unit 40, and applies pressure to the image on the record medium P. The external diameter of the pressure roller 60 is 40 [mm] and the hardness of the pressure roller 60 is desired to be 50° to 65°. The pressure roller 60 includes a surface layer 61, an adhesive layer 62, an elastic layer 63 and a shaft 64. Specifically, in the pressure roller 60, the elastic layer 63 is formed on the shaft 64, the adhesive layer 62 is formed on the elastic layer 63, and the surface layer 61 is formed on the adhesive layer 62. Incidentally, an adhesive layer may be provided between the shaft 64 and the elastic layer 63.

In this example, the surface layer 61 is configured to include PFA. The thickness of the surface layer 61 is 30 [μm], for example. The surface layer 61 slides on the record medium P and the fixation belt 53. Similarly to the surface layer 54 of the fixation belt 53, the thickness of the surface layer 61 is desired to be a size that enables the surface layer 61 to follow the deformation of the elastic layer 63. In contrast, if the thickness of the surface layer 61 is too small, wrinkles occur to the surface layer 61 due to the sliding on the fixation belt 53 and the sliding on the record medium P, and thus the thickness of the surface layer 61 is desired to be 15 to 50 [μm]. Further, the surface layer 61 is desired to have heat resistance to withstand the fixation temperature and to have releasability to inhibit toners remaining on the fixation belt 53 and paper dust deriving from the record medium P from sticking to the surface layer 61, and thus is desired to be made of material obtained by fluorine substitution. The material of the surface layer 61 is not limited to the illustrated material, and the thickness of the surface layer 61 is not limited to the illustrated thickness.

In this example, the adhesive layer 62 is configured to include a silicone adhesive agent having sufficient adhesivity, including electrically conductive material added thereto, and capable of withstanding the fixation temperature. The adhesive layer 62 bonds the elastic layer 63 and the surface layer 61 together to inhibit the peeling of the surface layer 61 from the elastic layer 63 and the occurrence of wrinkles. Since the adhesive layer 62 has electrical conductivity, the adhesive layer 62 inhibits accumulation of electric charge in the pressure roller 60 in continuous printing and electrostatic adhesion of paper dust or the like to the pressure roller 60, for example. Incidentally, while electrically conductive material is added to the adhesive layer 62 in this example, the adhesive layer 62 is not limited to this example; it is permissible even if no electrically conductive material is added to the adhesive layer 62. The material of the adhesive layer 62 is not limited to the illustrated materials.

In this example, the elastic layer 63 is configured to include silicone sponge having foamed cells to which electrically conductive material has been added. The thickness of the elastic layer 63 is 4 [mm], for example. Since the elastic layer 63 has electrical conductivity, the elastic layer 63 inhibits accumulation of electric charge in the pressure roller 60 in continuous printing and electrostatic adhesion of paper dust or the like to the pressure roller 60, for example. The elastic layer 63 is desired to have rubber hardness and thickness with which the nip part N can be formed. Further, the elastic layer 63 is desired to have sufficient heat storage performance so that the heat transmitted from the fixation belt 53 to the image and the record medium P is not lost. Furthermore, to prevent a nip mark from remaining in the compressed nip part N, the cell diameter of the foamed cells is desired to be small, and specifically, the average cell diameter of the foamed cells is desired to be 20 to 250 [μm]. In this example, the average cell diameter is 100 [μm]. Measurement of the average cell diameter was carried out by slicing silicone sponge by using a razor or the like, observing the slice of silicone sponge by using a CCD (charged-coupled device) microscope, measuring the cell diameters of ten foamed cells in an observation viewing angle, and obtaining the average value of these cell diameters as the measurement value. Incidentally, while electrically conductive material is added to the elastic layer 63 in this example, the elastic layer 63 is not limited to this example; it is permissible even if no electrically conductive material is added to the elastic layer 63. Further, while the elastic layer 63 is configured to include silicone sponge in this example, the configuration of the elastic layer 63 is not limited to this example; the elastic layer 63 may also be configured to include a different material. For example, the elastic layer 63 may be configured to include solid rubber. Incidentally, the thickness of the elastic layer 63 is not limited to the illustrated thickness.

The shaft 64 is a member having sufficient pressure resistance not to be deformed by the fixation pressure, and is configured to include solid stainless steel (SUS304), for example. Incidentally, while the shaft 64 includes SUS304 in this example, the shaft 64 is not limited to this example; the shaft 64 may also be configured to include a different material instead of SUS304. Further, while a solid shaft is used in this example, the shaft is not limited to this example; it is also possible to use a hollow shaft instead, for example.

8. Operation of Image Forming Apparatus

With the configuration described above, the image forming apparatus 1 forms an image on the record medium P as follows: Upon receiving the print data from the host device, the image forming apparatus 1 executes an image forming process by rotating the photosensitive drum 12 of each development unit 11.

The image forming apparatus 1 forms the electrostatic latent image on the surface of the photosensitive drum 12 in each development unit 11 by selectively applying light from the exposure unit 17 to the electrically charged surface of the photosensitive drum 12. Then, an image corresponding to the electrostatic latent image is formed on the photosensitive drum 12.

The image forming apparatus 1 rotates the hopping roller 4 by transmitting the motive power from the hopping motor (not shown) to the hopping roller 4, and thereby sends out the record medium P towards the registration roller pair 5. The registration roller pair 5 conveys the record medium P towards the image forming section 10. At that time, the front edge of the record medium P butts against the registration roller pair 5, by which the skewing of the record medium P is corrected.

Thereafter, the image forming apparatus 1 conveys the record medium P towards the fixing device 30 by rotating the transfer belt 19 in the circulating manner in the image forming section 10. At that time, the record medium P passes between the photosensitive drum 12 and the transfer roller 22.

In the image forming apparatus 1, upon forming the image on the surface of each photosensitive drum 12, a transfer process is executed by the transfer belt unit 18. At that time, in the transfer belt unit 18, while the transfer belt 19 conveys the record medium P, the transfer roller 22 attracts the image formed on the surface of the photosensitive drum 12. Consequently, the image is transferred from the photosensitive drum 12 onto the record medium P.

After the image has been transferred from each photosensitive drums 12 onto the record medium P, the image forming apparatus 1 conveys the record medium P to the fixing device 30. When the record medium P is conveyed thereto, the fixing device 30 executes a fixation process. At that time, the fixing device 30 fuses the image transferred onto the surface of the record medium P by heating and compressing the image, and thereby fixes the image on the record medium P.

After the image is fixed on the record medium P, the image forming apparatus 1 conveys the record medium P towards the stacker 9 and ejects the record medium P onto the stacker 9.

9. Behavior of Heat Diffusion Member in Fixing Operation

Next, a description will be given of the behavior of the heat diffusion member 50 in the fixing operation when the record medium P onto which the image has been transferred is conveyed from the image forming section 10 towards the fixing device 30.

When the fixing device 30 executes the fixing operation, the drive gear 35 transmits the motive power supplied from the annular belt motor to the pressure roller 60. At that time, due to the release of the levers 33L and 33R from the lever retaining members in response to the operation of the drive gear 35, the levers 33L and 33R rotate in the direction D1 (FIG. 4) respectively around the rotary bearings 34L and 34R as the rotary shafts. Accordingly, the fixation belt unit 40 is pressed against the pressure roller 60, by which the nip part N is formed in the fixation belt unit 40 and the pressure roller 60. In this example, the length of the nip part N in its lengthwise direction (transverse direction) is 227 [mm], and the length of the nip part N in its short-side direction (depth direction) orthogonal to the lengthwise direction is 8 to 11 [mm]. The load placed on the fixation belt unit 40 is 33 to 39 [kg] in regard to the whole of the nip part N, and is specifically 36 [kg], for example. Nip pressure corresponding to the load of 36 [kg] is 1.32 to 2.15 [kg/cm$^2$].

The pressure roller 60 is rotated by the motive power transmitted from the annular belt motor. The fixation belt 53 rotates accompanying the pressure roller 60 according to the rotation of the pressure roller 60. Accordingly, in the fixation belt unit 40, the inner peripheral surface 56S of the fixation belt 53 slides on the slide surface SF of the slide member 52 of the heat diffusion member 50 via the slide grease GR. At that time, in the fixation belt unit 40, the heat diffusion member 50 is pressed against the heater 44. In the fixing operation, electric current supplied from an external power supply is fed to each heating part through electric wires (not shown), by which the heater 44 generates heat. The heat generated by the heater 44 is transmitted to the heat diffusion member 50 via the thermally conductive grease and thereafter transmitted to the fixation belt 53 via the slide grease GR. By the passage of the record medium P through the nip part N, the image transferred onto the record medium P is supplied with heat from the fixation belt 53 and pressure from the nip part N. Consequently, the image is fixed on the record medium P.

10. Examination of Heat Diffusion Member

By using the image forming apparatus 1 and the fixing device 30 described above, examination of the heat diffusion member 50 was conducted. In this examination, the slide member 52 was formed with the thermally conductive filler particles 52F and the binder resin 52B as shown in FIG. 8, samples Sa, Sb, Sc, Sd, Se and Sf of the heat diffusion member 50 differing from each other in the compound ratio of the thermally conductive filler particles 52F included in the slide member 52 (namely, graphite weight compound ratio) were made, and thermal diffusivity in the thickness direction of the heat diffusion member 50 and arithmetic mean roughness Ra of the slide surface SF of the slide member 52 in the heat diffusion member 50 were measured in regard to each sample. The thickness of the heat diffusion member 50 in this example was designed so that the base member 51 is 490 [μm] thick, the slide member 52 is 10 [μm] thick, and the heat diffusion member 50 is 500 [μm] thick in total.

(10-1. Measurement of Graphite Weight Compound Ratio)

The graphite weight compound ratio in the embodiment was obtained from a weight decrement in thermogravimetry-differential thermal analysis (TG-DTA measurement) of the slide member 52. In the TG-DTA measurement, thermogravimeter-differential thermal analyzer TG/DTA 6220 (manufactured by Hitachi High-Tech Corporation) was used. Measurement conditions were as described below.

measurement conditions: in conformity with JIS K6226-2: 2003 (Table TB1 in FIG. 12)

measurement sample weight: 5 [mg]

Here, dry air is generally obtained by removing water vapor from atmospheric air, and the oxygen concentration of the dry air is assumed to be 20.9%.

The weight decrements in measurement step 1 and measurement step 2 in Table TB1 in FIG. 12 were caused by pyrolysis of the binder resin 52B in a nitrogen atmosphere. The weight decrement in the subsequent measurement step 3 was caused by combustion of carbon components in an oxygen atmosphere. In the measurement step 3, the weight decrement occurring from 400 [° C.] to 600 [° C.] was caused by combustion of carbon components of the pyrolyzed binder resin 52B, and the weight decrement occurring from 600 [° C.] to 700 [° C.] was caused by combustion of graphite alone. Based on this knowledge, the graphite weight was regarded as the weight decrement due to combustion from 600 [° C.] to 700 [° C.] in an air atmosphere after the pyrolysis in the nitrogen atmosphere, and the ratio of the graphite weight in the measurement sample weight was obtained as the graphite weight compound ratio in the embodiment.

(10-2. Measurement of Thermal Diffusivity)

In this measurement, the thermal diffusivity in the thickness direction was used as an index representing the thermal conductivity. In this measurement, the thermal diffusivity of the heat diffusion member 50 was measured by using a thermowave analyzer TA35 (manufactured by BETHEL Co., Ltd.). Measurement conditions were as described below.

detector: InSb surface processing: blackening processing with graphite spray on both sample surfaces (irradiation side, detector side)

heating light: semiconductor laser (wavelength: 808 [nm])

measurement atmosphere: air atmosphere, 25 [° C.]

(10-3. Measurement of Roughness)

In this measurement, the arithmetic mean roughness Ra stipulated in JIS (Japanese Industrial Standards) B0601: 2013 was measured as an index representing the roughness. In this measurement, the roughness was measured by using a Surfcoder SEF3500 (manufactured by Kosaka Laboratory Ltd.). Measurement conditions were as described below.

measurement direction: direction orthogonal to sheet feed direction evaluation length: 4 [mm]

measurement speed: 0.5 [mm/s]

cutoff value: 0.8 [mm]

The roughness was measured at three positions on the heat diffusion member 50 and the mean value of the three roughness values was obtained as the arithmetic mean roughness Ra of the sample.

(10-4. Measurement of Fixation Limit Temperature)

Further, in this measurement, fixation limit temperature when using each of the samples Sa to Sf of the heat diffusion member 50 was measured.

The fixation limit temperature is the lower limit of the surface temperature of the fixation belt 53 at which a fixation ratio is 80% or higher. The fixation ratio was obtained by sticking Mending tape (manufactured by 3M Company) on the image after the fixation, rolling a cylindrical weight 5 [cm] wide and 500 [g] in weight on the mending tape back and forth, thereafter slowly peeling away the mending tape, measuring the image density before and after the tape peeling by using a reflection densitometer, and calculating the fixation ratio according to the following expression:

$$\text{fixation ratio } [\%] = \frac{\text{image density after tape peeling}}{\text{image density before tape peeling}} \times 100.$$

(10-5. Evaluation of Printed Image)

Furthermore, evaluation was performed on the printed image obtained by using each of the samples Sa to Sf of the heat diffusion member 50.

In the evaluation of the printed image, the presence/absence of occurrence of a vertical streak-like image defect in fill-page 100% solid color printing was evaluated. In cases where the surface roughness Ra is high and the slide grease GR not uniformly but unevenly and partially exists between the fixation belt 53 and the heat diffusion member 50, temperature unevenness occurs on the surface of the fixation belt 53 due to the difference in the thermal conductivity, and a vertical streak appears as a level difference in gloss. Therefore, the vertical streak-like image defect is employed as an evaluation item. As the image evaluation, the presence/absence of a vertical streak having a width of 1 [mm] or more in the printed image was evaluated.

(10-6. Judgment on Printed Image)

Table TB2 in FIG. 13 shows the graphite weight compound ratio, the thermal diffusivity, the arithmetic mean roughness Ra, a decrement in the fixation limit temperature, the judgment on the printed image (presence/absence of occurrence of a vertical streak), and fixability improvement in regard to each of the samples Sa to Sf of the heat diffusion member 50 used for the judgment on the printed image. About the presence/absence of occurrence of a vertical streak, the circle mark "O" was put when no vertical streak occurred, and the cross mark "x" was put when a vertical streak occurred. About the fixability improvement, the cross mark "x" was put when the graphite weight compound ratio was 0 [wt %], and the circle mark "O" was put when the fixation limit temperature lowered compared to the case where the graphite weight compound ratio was 0 [wt %].

From the result shown in Table TB2, it became clear that the thermal diffusivity of the heat diffusion member 50 in the thickness direction increases and the fixation limit temperature can be lowered with the increase in the graphite weight compound ratio. This can be understood as follows: The addition of graphite as the thermally conductive filler particles 52F improves the thermal conductivity of the slide member 52, the heat from the heating member 70 can be quickly transmitted to the toners on the paper via the fixation belt 53, and the need of excessively heating the fixation belt 53 is eliminated.

Here, if the graphite weight compound ratio is higher than 49 [wt %], the ratio of the binder resin 52B in the slide member 52 is too low, and thus the slide member 52 peels off without sticking fast to the base member 51 and no slide layer can be formed. Thus, the slide member 52 sticks fast to the base member 51 and the slide layer can be formed if the graphite weight compound ratio is less than or equal to 49 [wt %].

On the other hand, it was found that the vertical streak-like image defect occurs to the printed image when using the sample whose graphite weight compound ratio is 49 [wt %]. This can be understood as follows: Tops of graphite particles and the inner peripheral surface 56S of the fixation belt 53 locally adhere to each other, the slide grease GR between the slide member 52 and the inner peripheral surface 56S of the fixation belt 53 is unlikely to uniformly spread in surface directions, and parts with a large amount of grease and parts with a small amount of grease are formed locally during the sliding. Since the surface roughness of the slide member 52 increases with the increase in the graphite weight compound ratio, even supposing that a slide member 52 whose graphite weight compound ratio is over 49 [wt %] successfully sticks to the base member 51, it can be considered that the slide grease GR becomes nonuniform and the vertical streak-like image defect occurs similarly to the case where the graphite weight compound ratio is 49 [wt %].

Further, it was found that the vertical streak-like image defect does not occur to the printed image with the samples whose graphite weight compound ratio is less than or equal to 34 [wt %]. Thus, it appears that the vertical streak-like image defect does not occur to the printed image with samples whose graphite weight compound ratio is less than or equal to a prescribed value between 34 [wt %] and 49 [wt %].

As above, it was found that the fixation limit temperature can be lowered by adding graphite to the slide member 52. Further, it was found that the image defect can be inhibited if the graphite weight compound ratio is less than or equal to 34 [wt %].

(10-7. Measurement of Wear Depth of Slide Member)

As an example of a side effect of the addition of graphite to the slide member 52, the slide member 52 becomes more likely to wear down and the base member 51 is exposed. When the base member 51 is exposed, deterioration in the slidability leads to an increase in abrasiveness of the inner peripheral surface 56S of the fixation belt 53, and a tear occurs to the fixation belt 53. Thus, breakage of the fixation belt 53 due to the exposure of the base member 51 in long-term use of an actual device can be inhibited by deriving the relationship between the compound ratio of graphite and wear depth and providing a slide member 52 whose film thickness is greater than the wear depth.

In this measurement, wear depth measurement of the slide member 52 by means of a frictional wear test was conducted in regard to the prepared samples Sa to Se in Table TB2 (FIG. 13) differing in the graphite weight compound ratio by using a load variable frictional wear test system HHS2000 (manufactured by Shinto Scientific Co., Ltd.). Measurement conditions were as described below.

probe: SUS304 stainless sphere ϕ2 [mm]
load: 150 [g]
slide speed: 20 [mm/s]
slide distance: 10 [m] (10 [mm]×500 to and fro reps)
slide direction: sheet feed direction The product of the load and the slide distance in the frictional wear test in this example is equal to the product of the nip pressure and the slide (travel) distance of the fixation belt 53 in an actual device in longitudinal feed printing of 60k (=60×1000) A4 sheets, from which the wear depth of the slide member 52 in long-term use of the actual device can be obtained. Table TB3 in FIG. 14 shows the pressure and the slide distance in the frictional wear test and in the actual device 60k-sheet printing. In this frictional wear test, the slide distance was set at a distance corresponding to longitudinally fed 60k A4 sheets. On the other hand, the operating life of the fixing device 30 is a distance corresponding to longitudinally fed 50k A4 sheets. Therefore, the slide distance in the frictional wear test reaches a range over the operating life of the fixing device 30, and the result of the frictional wear test is a test result taking a safety margin (margin) into account.

(10-8. Relationship Between Graphite Weight Compound Ratio and Film Thickness of Slide Member)

Figure 16:
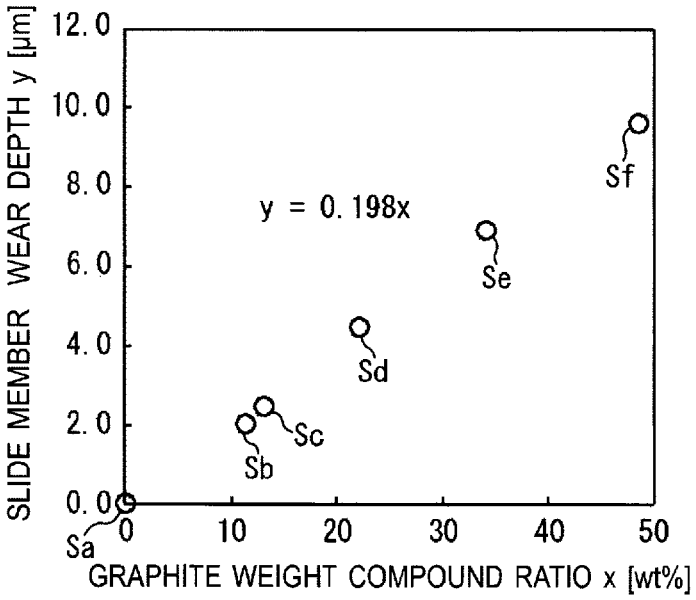
FIG. 16 is a graph showing the relationship between the graphite weight compound ratio and the slide member wear depth.

The relationship between the graphite weight compound ratio and the wear depth in regard to the samples Sa to Se of the heat diffusion member 50 is shown in Table TB4 in FIG. 15 and a graph in FIG. 16.

The tear of the fixation belt 53 due to the exposure of the base member 51 can be inhibited if the film thickness of the slide member 52 is made thicker than the wear depth corresponding to the graphite weight compound ratio. It became clear from the result in Table TB4 (FIG. 15) that the wear depth increases with the increase in the graphite weight compound ratio and a relationship y=0.198x holds in regard to the graphite weight compound ratio x and the wear depth y when an approximate straight line is drawn in FIG. 16. Accordingly, the tear of the fixation belt 53 can be inhibited if a relationship $t>0.198R_w$, holds in regard to the film thickness t [μm] of the slide member 52 and the graphite weight compound ratio $R_w$ [wt %] in the slide member 52.

(10-9. Relationship Between Graphite Volume Compound Ratio and Film Thickness of Slide Member)

While the weight compound ratio $R_w$ was used as the compound ratio of graphite in the above example, the compound ratio is not limited to the weight compound ratio; it is also possible to use a volume compound ratio $R_v$. In that case, the relationship between the film thickness and the graphite volume compound ratio can be obtained by converting the weight compound ratio into the volume compound ratio as described below.

Assuming that the weight of graphite is A [g], the weight of the whole of the slide member 52 is B [g], the density of graphite is α [g/cm$^3$] and the density of the binder resin 52B is β [g/cm$^3$], the weight compound ratio $R_w$ [wt %] of graphite is represented by the following expression (1):

$$R_w = \frac{A}{B} \times 100. \tag{1}$$

The following expression (2) is derived from the expression (1):

$$A = \frac{BR_w}{100}. \tag{2}$$

Next, the volume compound ratio $R_v$ [vol %] of graphite is represented by the following expression (3):

$$R_w = \frac{\frac{A}{\alpha}}{\frac{A}{\alpha} + \frac{B-A}{\beta}} \times 100 = \frac{\beta A}{(\beta-\alpha)A + \alpha B} \times 100. \tag{3}$$

The following expression (4) is derived by substituting the expression (2) into the expression (3):

$$R_v = \frac{100\beta\ R_w}{100\alpha + (\beta-\alpha)R_w}. \tag{4}$$

Further, the following expression (5) is derived by transposing $R_w$ in the expression (4) to the left side:

$$R_w = \frac{100\alpha\ R_v}{100\beta + (\alpha-\beta)R_v}. \tag{5}$$

Accordingly, the relationship between the film thickness of the slide member 52 and the graphite volume compound ratio is derived by substituting the expression (5) into the relational expression between the film thickness of the slide member 52 and the graphite weight compound ratio.

Namely, the tear of the fixation belt 53 can be inhibited if a relationship of the following expression (6) holds in regard to the film thickness t [μm] of the slide member 52, the graphite volume compound ratio $R_v$ [vol %] in the slide member 52, the density α [g/cm$^3$] of graphite and the density β [g/cm$^3$] of the binder resin 52B:

$$t > 0.198 \times \frac{100\alpha\ R_v}{100\beta + (\alpha-\beta)R_v}. \tag{6}$$

Figure 17:
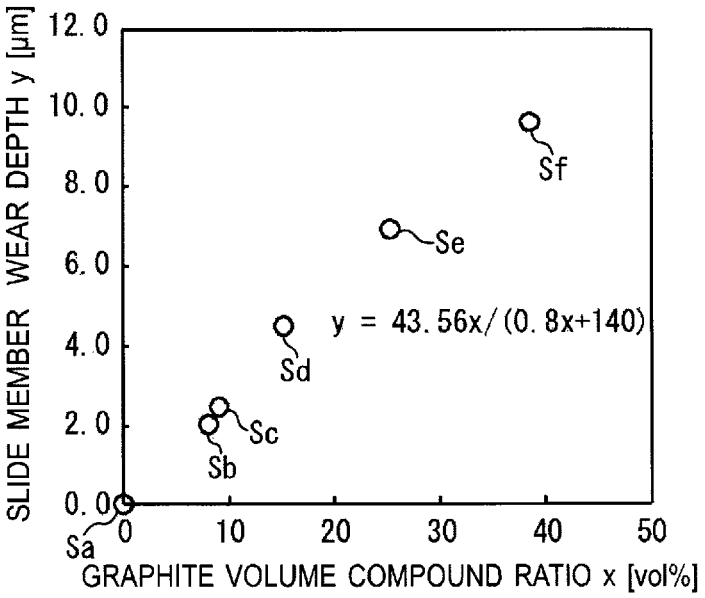
FIG. 17 is a graph showing the relationship between the graphite volume compound ratio and the slide member wear depth.

Assuming that the density of graphite in the slide member 52 is 2.2 [g/cm$^3$] and the density of the binder resin 52B is 1.4 [g/cm$^3$], the relationship between the graphite volume compound ratio and the wear depth in regard to the samples Sa to Se of the heat diffusion member 50 is shown in Table TB4 in FIG. 15 and a graph in FIG. 17.

The tear of the fixation belt 53 due to the exposure of the base member 51 can be inhibited if the film thickness of the slide member 52 is made thicker than the wear depth corresponding to the graphite volume compound ratio. According to the result in Table TB4, the wear depth increases with the increase in the graphite volume compound ratio similarly to the relationship with the graphite weight compound ratio. An approximate curved line can be drawn in FIG. 17 by substituting the right side of the aforementioned expression (5) into x in the approximate straight line y=0.198x drawn in FIG. 16, and it was found that a relationship y=43.56x/(0.8x+140) holds in regard to the graphite volume compound ratio x and the wear depth y. In this case, the density of graphite in the slide member 52 was assumed to be 2.2 [g/cm$^3$] and the density of the binder resin 52B was assumed to be 1.44 [g/cm$^3$]. Accordingly, the tear of the fixation belt 53 can be inhibited if a relationship t>43.56x/(0.8x+140) holds in regard to the film thickness t [μm] of the slide member 52 and the graphite volume compound ratio x [vol %] in the slide member 52.

(10-10. Thermal Diffusivity, Surface Roughness, Fixation Limit Temperature, Presence/Absence of Occurrence of Vertical Streak and Fixability Relative to Graphite Volume Compound Ratio)

The aforementioned Table TB2 in FIG. 13 further describes the graphite volume compound ratios in addition to the graphite weight compound ratios of the samples Sa to Se of the heat diffusion member 50. From the result shown in Table TB2, it became clear that the thermal diffusivity of the heat diffusion member 50 in the thickness direction increases and the fixation limit temperature can be lowered with the increase in the graphite volume compound ratio similarly to the relationship with the graphite weight compound ratio.

Here, if the graphite volume compound ratio is higher than 38 [vol %], the ratio of the binder resin 52B in the slide member 52 is too low, and thus the slide member 52 peels off without sticking fast to the base member 51 and no slide layer can be formed. Thus, the slide member 52 sticks fast to the base member 51 and the slide layer can be formed if the graphite volume compound ratio is less than or equal to 38 [vol %].

On the other hand, it was found that the vertical streak-like image defect occurs to the printed image when using the sample whose graphite volume compound ratio is 38 [vol %]. Since the surface roughness of the heat diffusion member 50 increases with the increase in the graphite volume compound ratio, even supposing that a slide member 52 whose graphite volume compound ratio is over 38 [vol %] successfully sticks to the base member 51, it can be considered that the slide grease GR becomes nonuniform and the vertical streak-like image defect occurs similarly to the case where the graphite volume compound ratio is 38 [vol %].

Further, it was found that the vertical streak-like image defect does not occur to the printed image with the samples whose graphite volume compound ratio is less than or equal to 25 [vol %]. Thus, it appears that the vertical streak-like image defect does not occur to the printed image with samples whose graphite volume compound ratio is less than or equal to a prescribed value between 25 [vol %] and 38 [vol %].

As above, it was found that the fixation limit temperature can be lowered by adding graphite to the slide member 52. Further, it was found that the image defect can be inhibited if the graphite volume compound ratio is less than or equal to 25 [vol %].

11. Effect and Other Features

In the above-described configuration, the fixing device 30 of the image forming apparatus 1 is configured so that the slide member 52 provided on the facing surface 51B of the heating member 70 for forming the nip part N, facing the inner peripheral surface 56S of the fixation belt 53, is configured to include the binder resin 52B and the thermally conductive filler particles 52F. Accordingly, with the thermally conductive filler particles 52F having higher thermal conductivity than the binder resin 52B, the fixing device 30 is capable of increasing the thermal diffusivity of the heat diffusion member 50 in the thickness direction and lowering the fixation limit temperature.

Accordingly, the fixing device 30 is capable of increasing the efficiency of the heat transmission from the heater 44 to the fixation belt 53 and reducing the power consumption of the heater 44. Further, the fixing device 30 is capable of increasing the printing speed by the lowering of the fixation limit temperature.

Furthermore, when the record medium P is fed to pass through the nip part N, heat in the fixation belt 53 in the first round is taken away to the record medium P; however, the fixing device 30 is capable of quickly heating the fixation belt 53 before the sheet feed to the fixation belt 53 in the second round thanks to the high efficiency of the heat transmission from the heater 44 to the fixation belt 53. Accordingly, the fixing device 30 is capable of securing sufficient fixation temperature even for a medium like thick paper that is likely to take away a lot of heat at the time of sheet feed, and thus the printing can be performed at the same printing speed irrespective of whether the medium is thin paper or thick paper and the medium versatility can be increased.

Specifically, in the fixing device 30, the graphite weight compound ratio is set higher than or equal to 11 [wt %] (i.e., the graphite volume compound ratio is set higher than or equal to 8 [vol %]).

Here, graphite as a carbon material is fragile and is softer and more easily scraped off compared to the fixation belt 53, and thus is capable of reducing the abrasiveness of the inner peripheral surface 56S of the fixation belt 53 sliding on the slide member 52 in comparison with other inorganic thermally conductive materials.

However, even though the increase in the amount of addition of graphite to the slide member 52 improves the thermal diffusiveness, the surface roughness of the slide member 52 increases, the slide grease GR becomes nonuniform on the slide surface SF, and there occurs a print failure in which the vertical streak-like image defect occurs.

To deal with this problem, in the fixing device 30, the graphite weight compound ratio is set less than or equal to 49 [wt %], and preferably less than or equal to 34 [wt %]. To describe this condition in terms of the graphite volume compound ratio, in the fixing device 30, the graphite volume compound ratio is set less than or equal to 38 [vol %], and preferably less than or equal to 25 [vol %]. Therefore, the fixing device 30 is capable of holding down the surface roughness of the slide member 52 and mitigating the nonuniformity of the slide grease GR on the slide surface SF. Accordingly, the fixing device 30 is capable of reducing the occurrence of the vertical streak and maintaining high print quality.

Further, as an example of the side effect of the addition of graphite to the slide member 52, the slide member 52 becomes more likely to wear down and the base member 51 is exposed. When the base member 51 is exposed, deterioration in the slidability leads to an increase in the abrasiveness of the inner peripheral surface 56S of the fixation belt 53, and a tear occurs to the fixation belt 53.

To deal with this problem, the fixing device 30 is configured so that the relationship $t>0.198R_w$ is satisfied in regard to the film thickness t [μm] of the slide member 52 and the graphite weight compound ratio $R_w$ [wt %] in the slide member 52. To describe this condition in terms of the graphite volume compound ratio, the fixing device 30 is configured to satisfy the aforementioned expression (6) in regard to the film thickness t [μm] of the slide member 52, the graphite volume compound ratio $R_v$ [vol %] in the slide member 52, the density α [g/cm$^3$] of graphite and the density β [g/cm$^3$] of the binder resin 52B.

Thus, the fixing device 30 is capable of inhibiting the breakage of the fixation belt 53 due to the exposure of the base member 51 in long-term use of the actual device by providing the slide member 52 whose film thickness is greater than the wear depth of the slide member 52 corresponding to the compound ratio of graphite. Accordingly, the fixing device 30 is capable of securing excellent fixation performance while avoiding the occurrence of the wear or abrasion to the inner peripheral surface 56S of the fixation belt 53. As above, the fixing device 30 prescribes the thickness of the slide member 52 corresponding to the compound ratio of graphite and that makes it possible to let the slide member 52 have sufficient durability, maintain the slide member 52 until the end of the operating life of the device, and inhibit the breakage of the fixation belt 53.

As above, in the fixing device 30, the slide member 52 is configured to include the thermally conductive filler particles 52F only less than or equal to a prescribed compound ratio and the film thickness of the slide member 52 is set at a sufficient film thickness corresponding to the compound ratio of the thermally conductive filler particles 52F. With this configuration, the fixing device 30 is capable of increasing the efficiency of the heat transmission from the heating member 70 and increasing the durability of the slide member 52, by which both the increase in the heat transmission efficiency of the heat diffusion member 50 and the increase in the durability of the slide member 52 can be achieved.

According to the configuration described above, the fixing device 30 of the image forming apparatus 1 includes the fixation belt 53, the heating member 70 provided on the inner peripheral surface 56S's side of the fixation belt 53, the slide member 52 provided on the facing surface 51B of the heating member 70 facing the inner peripheral surface 56S, and the pressure roller 60 that is provided on the outer peripheral surface's side of the fixation belt 53 and forms the nip part N as a nip region between the pressure roller 60 and the slide member 52 via the fixation belt 53, wherein the slide member 52 is configured to include at least the binder resin 52B as resin and the thermally conductive filler particles 52F as carbon.

Alternatively, the fixing device 30 of the image forming apparatus 1 includes the fixation belt 53, the heating member 70 provided on the inner peripheral surface 56S's side of the fixation belt 53, and the slide member 52 provided on the facing surface 51B of the heating member 70 facing the inner peripheral surface 56S, wherein the slide member 52 is configured to include at least the binder resin 52B as resin and the thermally conductive filler particles 52F as a thermally conductive material having higher thermal conductivity than the binder resin 52B so that a weight compound ratio of the thermally conductive filler particles 52F as the compound ratio of the thermally conductive filler particles 52F added relative to the weight ratio of the slide member 52 is higher than or equal to 11 [wt %] (i.e., a volume compound ratio of the thermally conductive filler particles 52F as the compound ratio of the thermally conductive filler particles 52F added relative to the volume ratio of the slide member 52 is higher than or equal to 8 [vol %]).

Accordingly, with the thermally conductive filler particles 52F having higher thermal conductivity than the binder resin 52B, the fixing device 30 is capable of increasing the thermal diffusivity of the heat diffusion member 50 in the thickness direction and lowering the fixation limit temperature.

12. Other Embodiments

In the above-described embodiment, a description was given of a case where graphite is used as the thermally conductive filler particles 52F. The embodiment is not limited to such a configuration; it is also possible to use carbon black or the like, being a carbon material similarly to graphite, as the thermally conductive filler particles 52F. As the thermally conductive filler particles 52F, it is also possible to use metal-based, metallic oxide-based, metal coating-based or metallic oxide coating-based material, such as boron nitride, aluminum oxide, zinc oxide or the like, as a thermally conductive material having high thermal conductivity. However, in the case where graphite is used as the thermally conductive filler particles 52F, the abrasiveness of the inner peripheral surface 56S of the fixation belt 53 sliding on the slide member 52 can be reduced since graphite as a carbon material is fragile and is softer and more easily scraped off compared to the fixation belt 53.

In the above-described embodiment, a description was given of a case where the slide member 52 is provided on the facing surface 51B of the heat diffusion member 50. The embodiment is not limited to such a configuration; it is also possible to leave out the heat diffusion member 50 and provide the slide member 52 on a surface of the heater 44 facing the inner peripheral surface 56S of the fixation belt 53. However, in the case where the heat diffusion member 50 is provided, the temperature unevenness in the lengthwise direction of the heater 44 can be mitigated when using the heater 44 controlling a plurality of heating elements aligned in the lengthwise direction of the heater 44, and rigidity of the whole of the heating member 70 can be increased compared to cases where the heating member 70 includes the heater 44 alone.

In the above-described embodiment, a description was given of a case where the slide grease GR is applied on the slide surface SF of the slide member 52. The embodiment is not limited to such a configuration; it is also possible to apply the slide grease GR not on the slide surface SF of the slide member 52 but on the inner peripheral surface 56S of the fixation belt 53, or to apply the slide grease GR on both of the slide surface SF of the slide member 52 and the inner peripheral surface 56S of the fixation belt 53. In short, it is permissible if the slide grease GR is situated between the slide surface SF of the slide member 52 and the inner peripheral surface 56S of the fixation belt 53.

In the above-described embodiment, a description was given of a case where the embodiment is applied to the image forming apparatus 1 of the so-called direct transfer type in which the toner image is directly transferred from the photosensitive drum 12 of each development unit 11 onto the record medium P. The embodiment is not limited to such application; it is also possible to apply the embodiment to an image forming apparatus of the so-called intermediate transfer type (or secondary transfer type) in which the toner image of each color is successively transferred from the photosensitive drum 12 of the corresponding development unit 11 onto an intermediate transfer belt in an overlaying manner and then the toner image is transferred from the intermediate transfer belt onto the record medium P.

In the above-described embodiment, a description was given of a case where the embodiment is applied to developing agents used for the single component development method. The embodiment is not limited to such application; it is also possible to apply the embodiment to developing agents used for the two-component development method in which the toner is provided with an appropriate amount of electrification by mixing the toner with a carrier and using friction between the carrier and the toner.

In the above-described embodiment, a description was given of a case where the embodiment is applied to the image forming apparatus 1 that includes four development units 11 and forms a color image by use of toners of four colors. The embodiment is not limited to such application; it is also possible to apply the embodiment to an image forming apparatus that includes three or less or five or more development units 11 and forms a color image by use of toners of a prescribed number of colors.

In the above-described embodiment, a description was given of a case where the embodiment is applied to the image forming apparatus 1 that is a single-function device as a printer. The embodiment is not limited to such application; it is also possible to apply the embodiment to an image forming apparatus having various other functions such as an MFP (Multi-Function Peripheral) having the functions of a copy machine and a facsimile machine, for example. The embodiment may be applied also to various types of electronic devices that form an image on a record medium P such as paper by the electrophotographic method by using a developing agent.

Further, the embodiment is not limited to the embodiment and the other embodiments described above. Namely, the scope of application of the embodiment ranges also to embodiments obtained by arbitrarily combining the above-described embodiment and part or all of the above-described other embodiments and embodiments obtained by extracting parts from the above-described embodiments.

In the above-described embodiment, a description was given of a case where the fixing device 30 is formed with the fixation belt 53 as an annular belt, the heating member 70, the slide member 52 as a facing member and the pressure roller 60 as a pressing member. The embodiment is not limited to such a configuration; the fixing device may also be formed with an annular belt, a heating member, a facing member and a pressing member having various other configurations.

In the above-described embodiment, a description was given of a case where the fixing device 30 is formed with the fixation belt 53 as an annular belt, the heating member 70, the slide member 52 as a facing member and the slide grease GR as a lubricant. The embodiment is not limited to such a configuration; the fixing device may also be formed with an annular belt, a heating member, a facing member and a lubricant having various other configurations.

INDUSTRIAL APPLICABILITY

The embodiment is applicable to cases where an image is printed on a specific medium by using an image forming apparatus of the electrophotographic type.

(Description of Reference Characters)

1: image forming apparatus, 2: printer housing, 3: sheet feed tray, 4: hopping roller, 5: registration roller pair, 6: ejection roller pair, 9: stacker, 10: image foaming section, 11: development unit, 12: photosensitive drum, 13: charging roller, 14: development roller, 15: cleaning blade, 16: toner storage section, 17: exposure unit, 18: transfer belt unit, 19: transfer belt, 20: drive roller, 21: driven roller, 22: transfer roller, 23: cleaning blade, 30: fixing device, 31L, 31R: side frame, 32L, 32R: spring, 33L, 33R: lever, 34L, 34R: rotary bearing, 35: drive gear, 40: fixation belt unit, 41: stay, 42L, 42R: screw, 43: holding member, 44: heater, 48: heat storage plate, 49F, 49B: holding groove, 50: heat diffusion member, 51: base member, 51A: counter facing surface, 51B: facing surface, 52: slide member, 52B: binder resin, 52F: thermally conductive filler particle, 53: fixation belt, 54, 61: surface layer, 55, 63: elastic layer, 56: base member layer, 56S: inner peripheral surface, 60: pressure roller, 62: adhesive layer, 64: shaft, 70: heating member, P: record medium, GR: slide grease, SF: slide surface.

What is claimed is:

1. A fixing device comprising:

an annular belt;

a heating member provided on an inner peripheral surface's side of the annular belt;

a facing member provided on a facing surface of the heating member facing the inner peripheral surface; and a pressing member that is provided on an outer peripheral surface's side of the annular belt and forms a nip region between the pressing member and the facing member via the annular belt, wherein the facing member includes resin and carbon.

2. The fixing device according to claim 1, further comprising a lubricant situated between the annular belt and the facing member, wherein a weight compound ratio of the carbon as a compound ratio of the carbon added relative to a weight ratio of the facing member is less than or equal to 49 [wt %].

3. The fixing device according to claim 1, wherein the weight compound ratio of the carbon is less than or equal to 34 [wt %].

4. The fixing device according to claim 1, wherein a relationship $t>0.198R_w$ is satisfied in regard to a thickness t [μm] of the facing member and a weight compound ratio $R_w$ [wt %] of the carbon.

5. The fixing device according to claim 1, further comprising a lubricant situated between the annular belt and the facing member, wherein a volume compound ratio of the carbon as a compound ratio of the carbon added relative to a volume ratio of the facing member is less than or equal to 38 [vol %].

6. The fixing device according to claim 1, wherein the volume compound ratio of the carbon is less than or equal to 25 [vol %].

7. The fixing device according to claim 1, wherein a following expression is satisfied in regard to a thickness t [μm] of the facing member, a volume compound ratio $R_v$ [vol %] of the carbon of the facing member, density α [g/cm$^3$] of the carbon and density β [g/cm$^3$] of the resin:

$$t > 0.198 \times \frac{100\alpha R_v}{100\beta + (\alpha - \beta)R_v}.$$

8. The fixing device according to claim 1, wherein a weight compound ratio of the carbon as a compound ratio of the carbon added relative to a weight ratio of the facing member is calculated from a weight decrement obtained in measurement performed in conformity with JIS K6226-2: 2003 by using a thermogravimeter-differential thermal analyzer (TG-DTA).

9. The fixing device according to claim 1, wherein a weight compound ratio of the carbon is higher than or equal to 11 [wt %].

10. The fixing device according to claim 1, wherein a volume compound ratio of the carbon is higher than or equal to 8 [vol %].

11. The fixing device according to claim 1, wherein a surface roughness of the facing member in contact with the inner peripheral surface of the annular belt is higher than or equal to 0.95 [μm] and less than or equal to 1.56 [μm].

12. An image forming apparatus comprising the fixing device according to claim 1.

13. A fixing device comprising:

an annular belt;

a heating member provided on an inner peripheral surface's side of the annular belt; and a facing member provided on a facing surface of the heating member facing the inner peripheral surface, wherein the facing member includes resin and a thermally conductive material having higher thermal conductivity than the resin, and a weight compound ratio of the thermally conductive material as a compound ratio of the thermally conductive material added relative to a weight ratio of the facing member is higher than or equal to 11 [wt %].

14. The fixing device according to claim 13, further comprising a lubricant situated between the annular belt and the facing member, wherein the weight compound ratio of the thermally conductive material is less than or equal to 49 [wt %].

15. The fixing device according to claim 13, wherein a relationship $t>0.198R_w$ is satisfied in regard to a thickness t [μm] of the facing member and the weight compound ratio $R_w$ [wt %] of the thermally conductive material.

16. The fixing device according to claim 13, wherein the thermally conductive material is carbon.

17. A fixing device comprising:

an annular belt;

a heating member provided on an inner peripheral surface's side of the annular belt; and a facing member provided on a facing surface of the heating member facing the inner peripheral surface, wherein the facing member includes resin and a thermally conductive material having higher thermal conductivity than the resin, and a volume compound ratio of the thermally conductive material as a compound ratio of the thermally conductive material added relative to a volume ratio of the facing member is higher than or equal to 8 [vol %].

18. The fixing device according to claim 17, further comprising a lubricant situated between the annular belt and the facing member, wherein the volume compound ratio of the thermally conductive material is less than or equal to 38 [vol %].

19. The fixing device according to claim 17, wherein a following expression is satisfied in regard to a thickness t [μm] of the facing member, a volume compound ratio $R_v$ [vol %] of the thermally conductive material, density α [g/cm$^3$] of the thermally conductive material and density β [g/cm$^3$] of the resin:

$$t > 0.198 \times \frac{100\alpha R_v}{100\beta + (\alpha - \beta)R_v}.$$

20. The fixing device according to claim 17, wherein the thermally conductive material is carbon.

* * * * *